US010808944B2

(12) United States Patent
Bianchi et al.

(10) Patent No.: US 10,808,944 B2
(45) Date of Patent: Oct. 20, 2020

(54) SWINGING RACK

(71) Applicant: WHIRLPOOL CORPORATION, Benton Harbor, MI (US)

(72) Inventors: Fabio Bianchi, Ranco (IT); Emilio R. Fagundes, St. Joseph, MI (US); Valerio S. Hammes, Jr., St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 99 days.

(21) Appl. No.: 15/869,498

(22) Filed: Jan. 12, 2018

(65) Prior Publication Data

US 2019/0219271 A1 Jul. 18, 2019

(51) Int. Cl.
*F24C 15/16* (2006.01)

(52) U.S. Cl.
CPC ..... *F24C 15/16* (2013.01)

(58) Field of Classification Search
CPC ..... F24C 15/16; F24C 15/162; F24C 15/02
USPC ..... 126/339, 332, 337 R
See application file for complete search history.

(56) References Cited

U.S. PATENT DOCUMENTS

| | | | |
|---|---|---|---|
| 774,117 | A | 11/1904 | Tandy |
| 1,387,950 | A | 8/1921 | Sperl et al. |
| 2,282,342 | A | 5/1942 | Preble |
| 2,412,904 | A | 12/1946 | Money et al. |
| 2,434,117 | A | 1/1948 | Money et al. |
| 2,466,360 | A | 4/1949 | Bitney |
| 2,477,305 | A | 7/1949 | Leighton |
| 2,509,592 | A | 5/1950 | Giffard |
| 2,517,385 | A | 8/1950 | Clark |
| 2,573,272 | A | 10/1951 | Petkwitz |
| 2,597,267 | A | 5/1952 | Shoemaker et al. |

(Continued)

FOREIGN PATENT DOCUMENTS

| | | | |
|---|---|---|---|
| BR | PI0100491 | B1 | 6/2009 |
| BR | PI0805999 | A2 | 6/2010 |

(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.

(Continued)

*Primary Examiner* — Steven B McAllister
*Assistant Examiner* — Charles R Brawner
(74) *Attorney, Agent, or Firm* — Price Heneveld LLP

(57) ABSTRACT

An oven rack assembly includes first and second mounting members and a first frame member being movably coupled with the first mounting member and the second mounting member at spaced apart positions along an axis of the first frame member and supported by the first and second mounting members between a first vertical position and a second vertical position higher than the first vertical position. The first and second mounting members move the first frame member between the first and second vertical positions with movement of the first frame member in a direction of the axis. The assembly further includes a first rack supported on a least a first side thereof by the first frame member and coupled with the first frame member to be slideable with respect thereto along the axis.

15 Claims, 9 Drawing Sheets

(56) References Cited

U.S. PATENT DOCUMENTS 2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,410,260 A 11/1968 Morgan
3,866,437 A 2/1975 Spencer
4,638,644 A 1/1987 Gidseg
4,732,435 A 3/1988 Bailey et al.
4,834,557 A 5/1989 Dreinhoff
4,914,928 A 4/1990 Fellwock et al.
4,998,382 A 3/1991 Kostos et al.
5,362,145 A 11/1994 Bird et al.
5,415,472 A 5/1995 Brise
5,429,043 A 7/1995 Becker
5,447,146 A 9/1995 Nickerson
5,524,981 A 6/1996 Herrmann et al.
5,564,809 A 10/1996 Kane et al.
5,660,777 A 8/1997 Herrmann et al.
5,735,589 A 4/1998 Hermann et al.
5,813,741 A 9/1998 Fish et al.
5,918,959 A 7/1999 Lee
6,045,101 A 4/2000 Goyette et al.
6,148,813 A * 11/2000 Barnes ..... A47B 88/487 126/339
6,174,482 B1 1/2001 Reames et al.
6,220,684 B1 4/2001 Bent et al.
6,474,094 B2 11/2002 Kim
6,488,347 B1 12/2002 Bienick
6,604,800 B2 8/2003 Hamilton
6,811,045 B1 11/2004 Masker et al.
D505,140 S 5/2005 Reed et al.
6,945,245 B1 * 9/2005 Wilson ..... F24C 15/16 126/215
D516,100 S 2/2006 Vardon
D516,102 S 2/2006 Vardon
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D551,262 S 9/2007 Becke
7,270,385 B2 9/2007 Mathur et al.
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
D656,970 S 4/2012 Merritt
8,172,347 B2 5/2012 Lim et al.
8,240,512 B2 8/2012 Sunatori
D669,506 S 10/2012 Czach
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,127,878 B2 9/2015 Gossens et al.
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
D756,551 S 5/2016 Handt et al.
9,328,955 B2 5/2016 Castro Solis et al.
9,339,993 B2 5/2016 Cites et al.
D761,884 S 7/2016 Austin et al.
9,488,405 B2 11/2016 Lee et al.
9,500,403 B2 11/2016 Seo et al.
9,540,679 B2 1/2017 Cha
9,671,115 B2 6/2017 Elkasevic
9,861,200 B2 1/2018 Lim
2003/0020387 A1 1/2003 Wing et al.
2004/0012314 A1 1/2004 Hay et al.
2004/0104323 A1 6/2004 Hubert et al.
2005/0073225 A1 4/2005 Kwon et al.
2006/0145577 A1 7/2006 Daley et al.
2006/0226751 A1 10/2006 Park
2006/0250058 A1 * 11/2006 Stevens ..... A47L 15/502 312/311
2007/0126325 A1 6/2007 Gorz et al.
2008/0203041 A1 8/2008 Lim et al.
2010/0024464 A1 2/2010 Hwang et al.
2010/0102693 A1 4/2010 Driver et al.
2010/0109498 A1 5/2010 Ramm et al.
2011/0001415 A1 1/2011 Park et al.
2011/0072846 A1 3/2011 Engel et al.
2011/0115356 A1 5/2011 Nash et al.
2012/0018434 A1 1/2012 Gwak
2012/0091084 A1 4/2012 Amaral et al.
2012/0223038 A1 9/2012 Bean
2013/0020922 A1 1/2013 Jang
2015/0034668 A1 2/2015 Minard et al.
2015/0061484 A1 3/2015 Jeong et al.
2015/0107084 A1 4/2015 Craycraft et al.
2015/0168048 A1 6/2015 Sexton et al.
2015/0184929 A1 7/2015 Moon
2016/0290707 A1 10/2016 Burke et al.
2017/0086580 A1 3/2017 Conti
2017/0181538 A1 6/2017 Azkue et al.
2019/0041065 A1 * 2/2019 Park ..... F24C 15/168

FOREIGN PATENT DOCUMENTS

CN 101611281 A 12/2009
CN 201779952 U 3/2011
CN 102135363 A 7/2011
CN 102395849 A 3/2012
CN 102494496 A 6/2012
CN 202432813 U 9/2012

(56) References Cited

FOREIGN PATENT DOCUMENTS

| | | | |
|---|---|---|---|
| CN | 102135363 | B | 12/2012 |
| CN | 102829604 | A | 12/2012 |
| CN | 102889744 | A | 1/2013 |
| DE | 8801508 | U1 | 6/1989 |
| DE | 10107646 | A1 | 8/2002 |
| DE | 102009045363 | A1 | 4/2011 |
| DE | 102013216974 | A1 | 4/2014 |
| DE | 102012223131 | A1 | 6/2014 |
| EP | 577939 | A1 | 1/1994 |
| EP | 0577939 | A1 | 1/1994 |
| EP | 1790250 | A2 | 5/2007 |
| EP | 1349802 | B1 | 8/2008 |
| EP | 2072937 | A2 | 6/2009 |
| EP | 2098810 | A2 | 9/2009 |
| EP | 2424421 | B1 | 10/2015 |
| EP | 2760315 | B1 | 8/2016 |
| EP | 3438550 | A2 | 2/2019 |
| JP | H10115485 | A | 5/1998 |
| JP | H10122733 | A | 5/1998 |
| JP | H11237173 | A | 8/1999 |
| JP | 2002090054 | A | 3/2002 |
| KR | 100431346 | B1 | 5/2004 |
| KR | 20040095421 | A | 11/2004 |
| KR | 100756887 | B1 | 9/2007 |
| KR | 20100023474 | A | 3/2010 |
| KR | 20140022598 | A | 2/2014 |
| WO | 0214761 | A1 | 2/2002 |
| WO | 2004020910 | A1 | 3/2004 |
| WO | 2004104504 | A1 | 12/2004 |
| WO | 2005012812 | A1 | 2/2005 |
| WO | 2007128734 | A1 | 11/2007 |
| WO | 2008015180 | A1 | 2/2008 |
| WO | 2008015180 | A2 | 2/2008 |
| WO | 2009155679 | A1 | 12/2009 |
| WO | 2009155679 | A2 | 12/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Profile_SideBySide.

"Refrigerator Capacity & Organization: Making Room for More," GE Appliances, website, date unknown, http://www.geappliances.ca/en/shopping-guides-and-design-ideas/shopping-guides/refrigerators/make-room-for-more-in-the-refrigerator.

"GE Profile Side by Side Refrigerators," Abt, website, date unknown, http://www.abt.com/ge/GE_Profile_SidebySide.

* cited by examiner

SWINGING RACK

BACKGROUND

The present device generally relates to a rack assembly for an oven. In particular, the rack assembly raises an oven rack in connection with sliding movement of the rack out of the oven cavity.

In general, oven racks are used in connection with ovens that include an interior liner defining a cavity with an opening thereto and a floor surface extending inward from the opening. A door is typically included with such ovens and is positioned over the associated opening in a closed state and seals against a face of the oven surrounding opening against loss of heat from the cavity. The door may be hingedly connected with the oven so as to be moveable from the closed position to an open position to allow access to the cavity through the opening. Many of such doors and the associated hinged connections are such that, when in the open position, a portion of the door may extend over a corresponding portion of the opening. A typical oven door is hinged toward the floor of the cavity such that door opens downwardly away from the opening. In this manner, the inner face of the door extends over a portion of opening disposed toward the intersection of the opening with the floor of the cavity. In some ovens, positioning of at least one rack immediately adjacent the floor may be desired, but if mounted in a typical inward and outward sliding manner, the liner of the door extending over the lower portion of the opening may obstruct outward sliding of a rack in such a position from being extendable out of the cavity. As is generally known, the ability to slide the rack outwardly from the cavity is significant in allowing a user to easily place objects for cooking or heating inside the oven cavity, particularly with respect to objects that are heavy, irregular, small, or the like, as such sliding allows a user to place an object on the rack when outside (or at least partially outside) the cavity without having to reach into the cavity. Accordingly, further advances may be desired.

SUMMARY

In at least one aspect of the disclosure, an oven rack assembly includes first and second mounting members and a first frame member being movably coupled with the first mounting member and the second mounting member at spaced apart positions along an axis of the first frame member and supported by the first and second mounting members between a first vertical position and a second vertical position higher than the first vertical position. The first and second mounting members move the first frame member between the first and second vertical positions with movement of the first frame member in a direction of the axis. The assembly further includes a first rack supported on a least a first side thereof by the first frame member and coupled with the first frame member to be slideable with respect thereto along the axis.

In at least another aspect, an oven includes an interior liner defining a cavity having an opening and a floor surface extending inward from the opening and a door moveable between an open position and a closed position over the opening of the cavity, a portion of the door extending over a portion of the opening when in the open position. A first rack is mounted within the cavity and moveable in an outward direction with respect to the cavity and in a vertical direction between a first vertical position disposed below the door in the open position and a second vertical position disposed above the door in the open position.

In at least another aspect, an oven rack assembly includes first and second mounting members and a first rack supported on the first and second mounting members and moveable along an axis thereof in a sliding manner with respect to the first and second mounting members and in a vertical direction between a first vertical position and a second vertical position higher than the first vertical position. The first and second mounting members move the first rack between the first and second vertical positions with movement of the first rack along the axis.

These and other features, advantages, and objects of the present device will be further understood and appreciated by those skilled in the art upon studying the following specification, claims, and appended drawings.

DETAILED DESCRIPTION OF EMBODIMENTS

Figure 1:
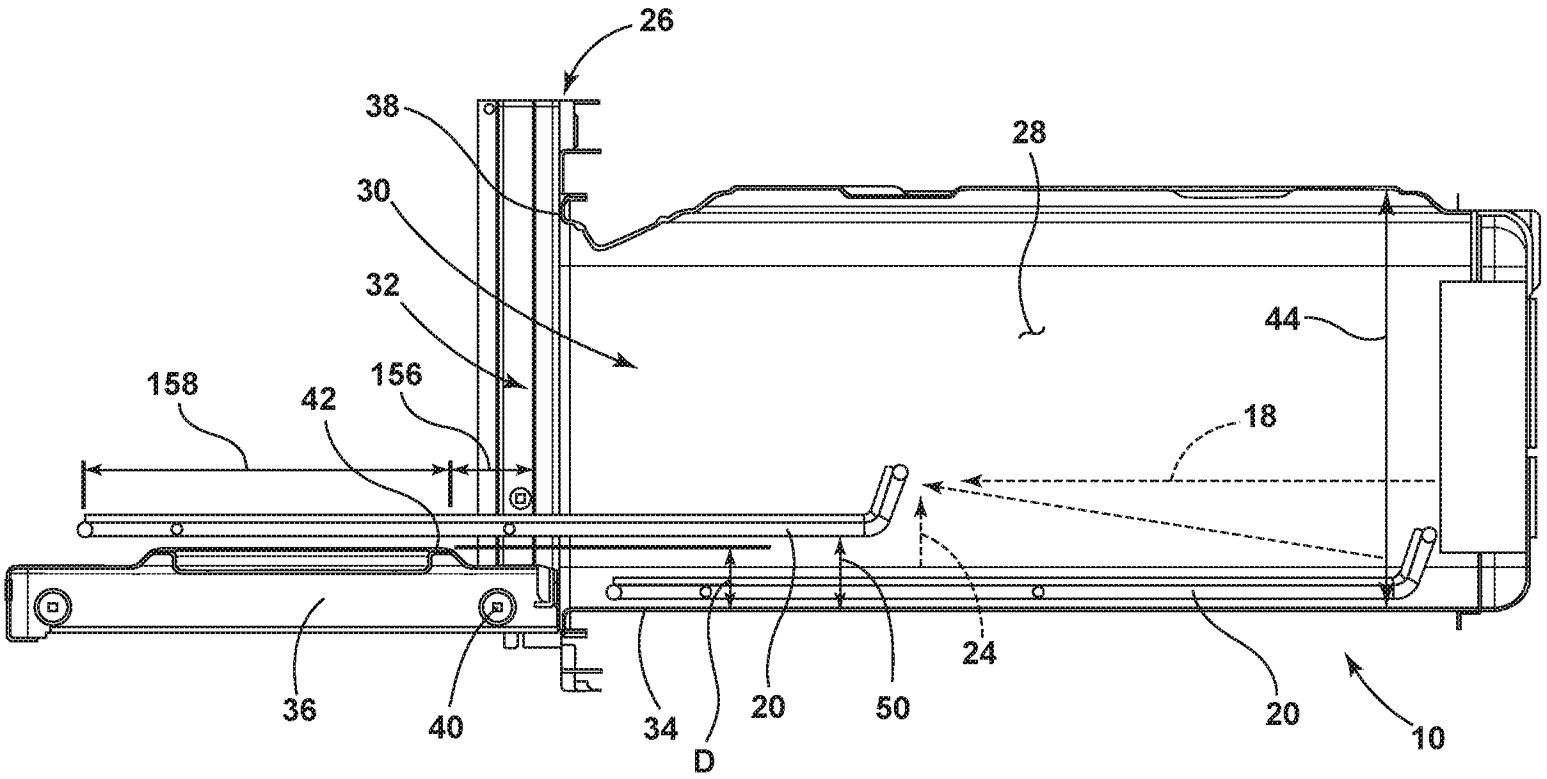
FIG. 1 is a side cross-section view of a portion of an oven cavity showing movement of a rack therein between two positions vertically and horizontally displaced from each other.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-4, reference numeral 10 generally designates an oven rack assembly. Oven rack assembly 10 includes a first mounting member 12 and a second mounting member 14 and a first frame member 16 being movably coupled with the first mounting member 12 and the second mounting member 14 at spaced apart positions along an axis 18 of the first frame member 16 and supported by the first 12 and second 14 mounting members between a first vertical position and a second vertical position higher than the first vertical position. The first 12 and second 14 mounting members move the first frame member 16 between the first and second vertical positions with movement of the first frame member 16 in the direction of the axis 18. The oven rack assembly 10 further includes a first rack 20 supported on a least a first side 22 thereof by the first frame member 16 and coupled with the first frame member 16 to be slideable with respect thereto along the axis 18.

As shown in the figures, the first rack 20 can be in the general form of a standard wire oven rack configured for supporting various food products, cooking vessels, or other articles thereon and of materials and construction capable of withstanding the high temperatures present in an oven during operation. First rack 20 can be sized, as needed, to fit within the particular oven in which it is intended to be used and to be used in conjunction with the particular implementation of first and second mounting members 12, 14, as discussed further below, within the particular oven. In this manner, the first and second mounting members 12,14 are arranged to allow the first rack 20 to be moveable along axis 18 in a sliding manner as well as in vertical direction 24 with movement of the first rack 20 along the axis 18.

As further shown, oven rack assembly 10 can be used in connection with the oven 26 shown in FIG. 1. In particular, oven 26 can include an interior liner 28 defining a cavity 30 having an opening 32 and a floor surface 34 extending inward from the opening 32. A door 36 is included with oven 26 and is positioned over opening 32 in a closed state and seals against a face 38 of oven 26 surrounding opening 32 against loss of heat from cavity 30. Door 36 is hingedly connected with oven 26 so as to be moveable from the closed position to an open position, as shown in FIG. 1, to allow access to the cavity 30 through opening 32. As further shown in FIG. 1, when in the open position, door 36, by way of the structure of the hinge 40, the location of hinge 40 with respect to opening 32, and the structure of door 36, may have a portion thereof that extends over a corresponding portion of opening 32. As show, door 36, in the configuration of a typical oven door, is hinged toward the floor 34 of cavity 30 such that door 36 opens downwardly away from opening 32. In this manner, the inner face 42 of door 36 extends over a portion of opening 32 disposed toward the intersection of opening 32 with the floor 34 of cavity 30.

In some embodiments of oven 26, positioning of at least one rack, including the depicted rack 20, immediately adjacent floor 34 may be desired, but if mounted in a typical inward and outward sliding manner, the liner 28 of door 36 extending over the lower portion of opening 32 may obstruct outward sliding of rack 20 in such a position from being extendable out of cavity 30. As is generally known, the ability to slide rack 20 outwardly from cavity 30 is significant in allowing a user to easily place objects for cooking or heating inside cavity 30, particularly with respect to objects that are heavy, irregular, small, or the like, as such sliding allows a user to place an object on rack 20 when outside (or at least partially outside) cavity 30 without having to reach into cavity 30. In various implementations of oven 26 wherein it is desired to place rack 20 in a position close to floor 34, it may also be desired to still permit outward sliding of rack 20 in the direction of axis 18 to allow for convenient positioning of objects within cavity 30.

In one aspect, oven 26 can be a secondary oven 26 within a dual-oven appliance, with the depicted oven 26 being generally smaller than what would be considered a primary oven. In such an arrangement the discussed positioning of rack 20 generally adjacent floor 34 can allow for larger objects to be positioned within cavity 30 than would be otherwise possible, given the lower height 44 of cavity 30 compared to a primary oven cavity. Further, such a secondary oven 26 may be positioned below a primary oven or may otherwise be provided with a heating element located on the top of cavity 30 such that a lower positioning of rack 20 may provide for more even heating of objects on rack 20. It is noted that stand-alone ovens may be structured so as to present similar spacing concerns for an associated rack, or other concerns for which the present solution would be similarly advantageous.

Accordingly, the preset oven rack assembly 10 is structured, as discussed above, to allow for both horizontal sliding of rack 20 in the direction of axis 18 as well as raising and lowering thereof in vertical direction 24. In the embodiment illustrated in FIGS. 2-7, such raising and lowering of rack 20 is linked with horizontal movement of rack 20 by structuring mounting members 12 and 14 as tracks having respectively upwardly-angled portions 46. As discussed above, first frame member 16 is supported on mounting members 12. In particular, corresponding rollers 48 are coupled with first frame member 16 such that first frame member 16 is moveably coupled with mounting members 12 and 14 by receipt of rollers 48 therein. The upwardly-angled track portions 46 of mounting members 12 and 14 can be arranged to provide the desired positioning of rack 20 adjacent floor 34 when rack 20 is fully retracted within cavity 30 (i.e., to allow closing of door 36 for heating of objects supported on rack 20), while allowing for rack 20 to clear door 36 when moving outwardly from cavity 30.

Figure 5:
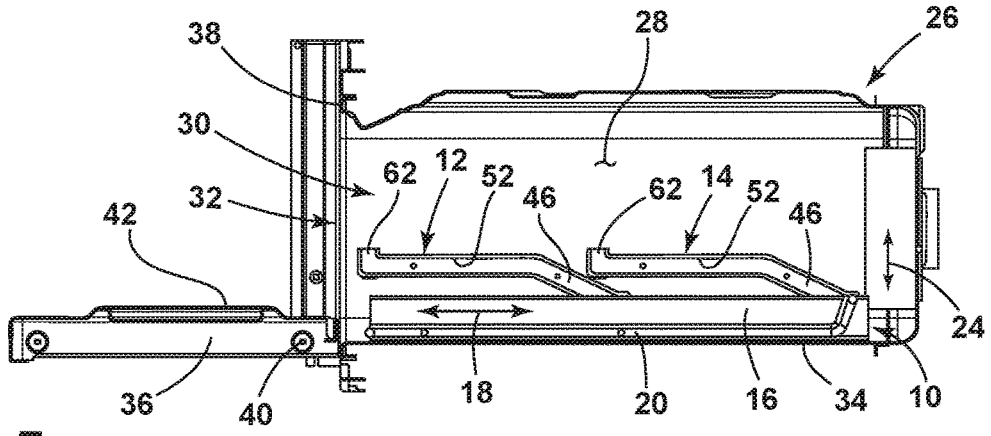
FIG. 5 is a side cross-section view of the oven rack assembly of FIG. 2 in place within an oven cavity in a first movement stage thereof.
Figure 6:
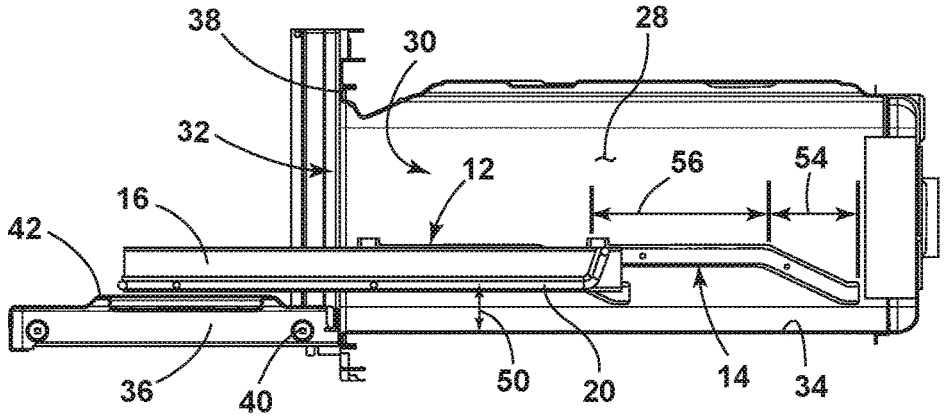
FIG. 6 is side cross-section view of the oven rack assembly of FIG. 2 in place within an oven cavity in a second movement stage thereof.

As particularly shown in FIGS. 5 and 6, the vertical distance 50 by which rack 20 is raised by movement through upwardly-angled portions 46 can be achieved by movement through only a portion 54 of the total distance that rack 20 can be moved along axis 18. In this manner, initial movement or rack 20 in the direction of axis 18 through the initial portion 54 of movement can cause the movement of rollers 48 within the respective upwardly-angled track portions 46 to raise first frame member 16 through the desired vertical distance 50 for movement of rack 20. Such movement through vertical distance 50 can raise rack 20 to a position such that further outward movement along axis 18 is possible without rack 20 contacting or being blocked by any portion of door 36 extending over opening 32 when in the open position. Additionally, the vertical distance 50 through with rack 20 is raised by such movement can provide clearance for a user to be able to grasp and manipulate rack and/or continue to move rack beyond any portion of door 36 within opening 32, including while wearing an oven mitt or the like.

Figure 4:
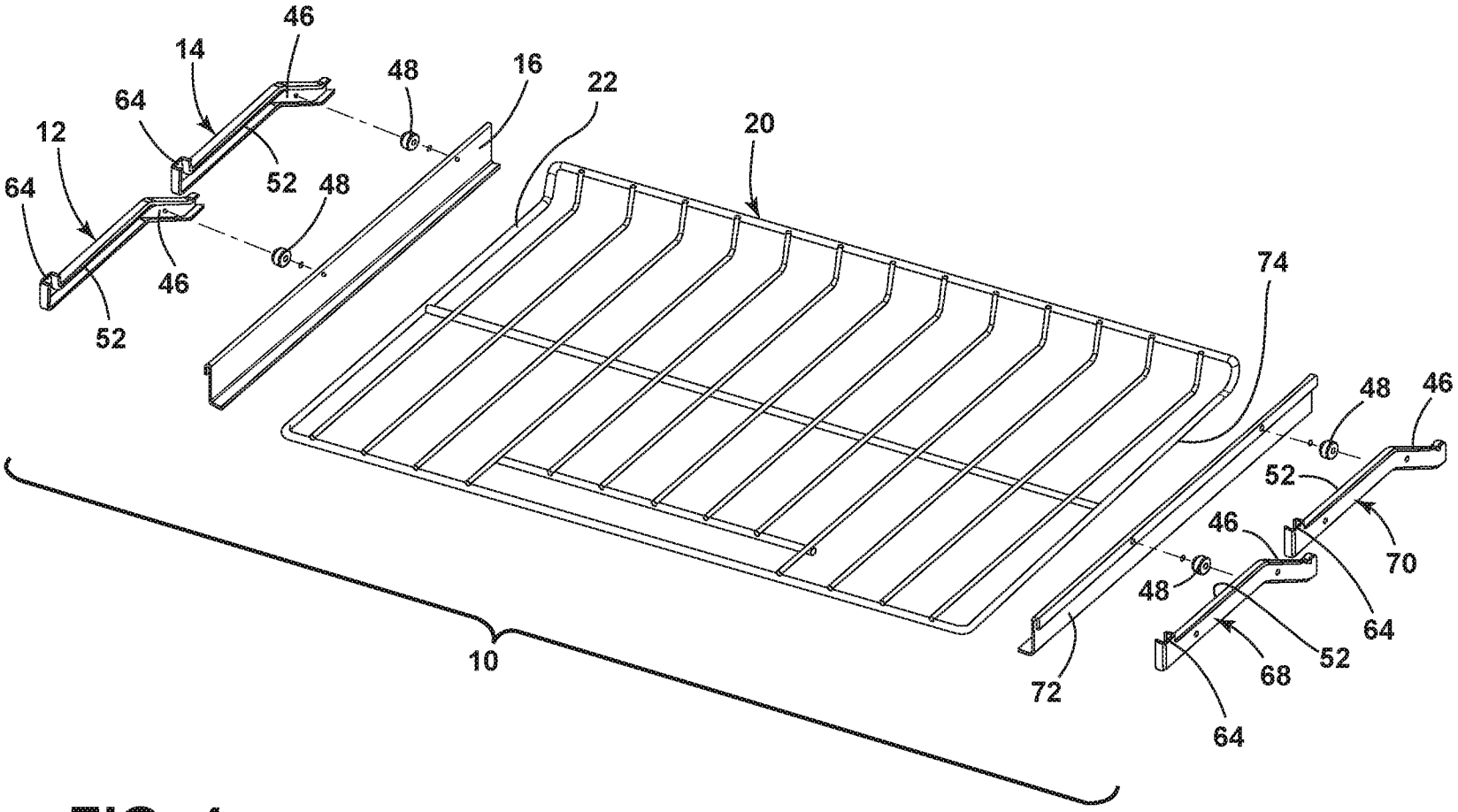
FIG. 4 is a perspective assembly view of the oven rack assembly of FIG. 2.

As further illustrated in FIGS. 5 and 6, mounting members 12 and 14 can be structured to facilitate outward movement of rack 20 in the direction of axis 18 alone (i.e., without additional movement of rack 20 in vertical direction 24) after rollers 48 have moved past the upwardly-angled track portions 46. In particular, mounting members 12,14 may additionally define horizontal track portions 52 that extend in the direction of axis 18 away from upwardly-angled track portions 46. As shown in FIGS. 4 and 5, horizontal track portions 52 extend away from upwardly-angled track portions 46 toward opening 32 such that, by way of rollers 48 traversing horizontal track portions 52, first frame member 16 can move outwardly with respect to cavity 30, thereby allowing further outward movement of rack 20 thereby providing a first range of horizontal sliding movement 56 for rack 20.

Figure 7:
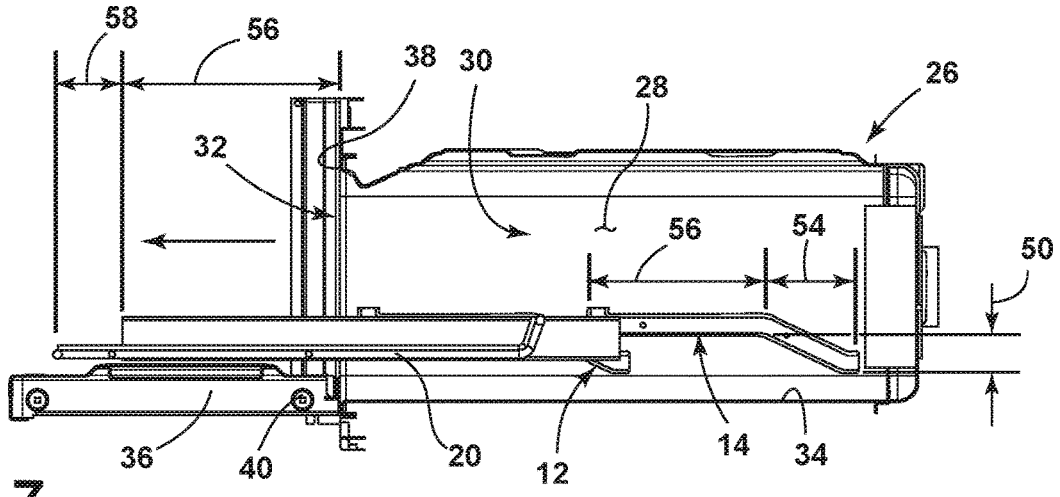
FIG. 7 is a side cross-section view of the oven rack assembly of FIG. 2 in place within an oven cavity in a third movement stage thereof.

As shown in FIGS. 6 and 7, however, the length of horizontal track portions 52 may be limited by the distance between mounting members 12 and 14, as well as the distance between first mounting member 12 and opening 32. In this manner, the outward movement facilitated by movement of rollers 48 and, thereby, first frame member 16 through both upwardly-angled track portions 46 and horizontal track portions 52 may not provide the desired amount of outward movement of rack 20 with respect to cavity 30. Accordingly, as can be seen in FIG. 7, rack 20 can be slidably supported by or otherwise affixed with first frame member 16 to allow for rack 20 to slide outwardly with respect to cavity 30 in direction of axis 18 independently of first frame member 16 to provide a second range of horizontal sliding movement 58 for rack 20.

Figure 2:
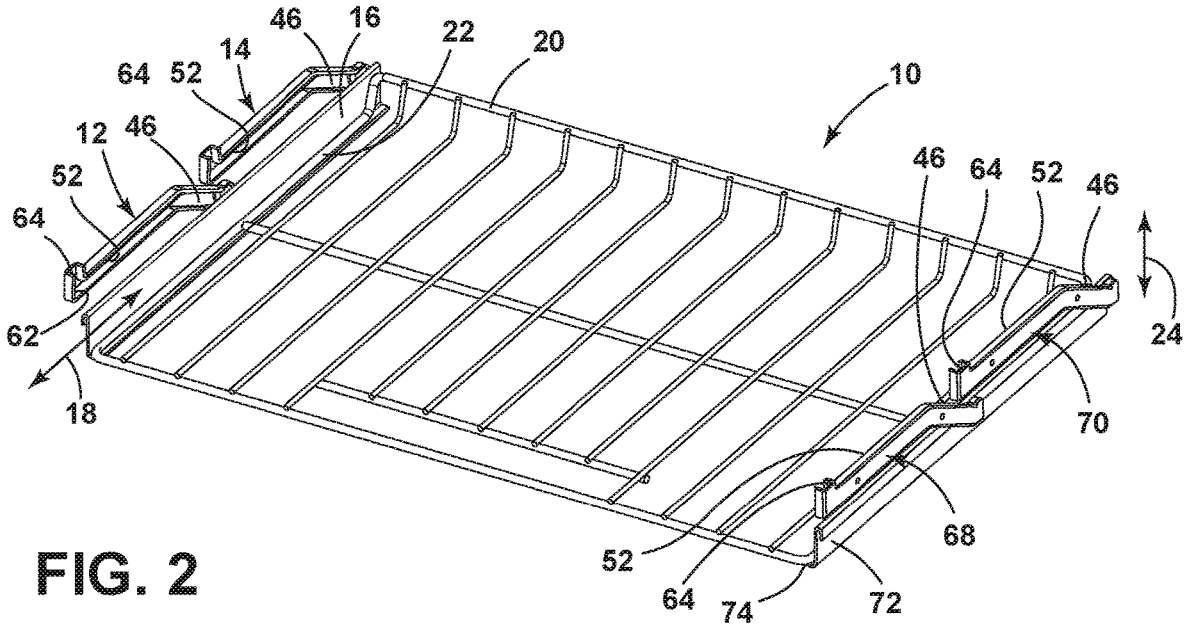
FIG. 2 is a perspective view of an oven rack assembly including a frame member slidably supported on mounting members within the oven cavity.
Figure 3:
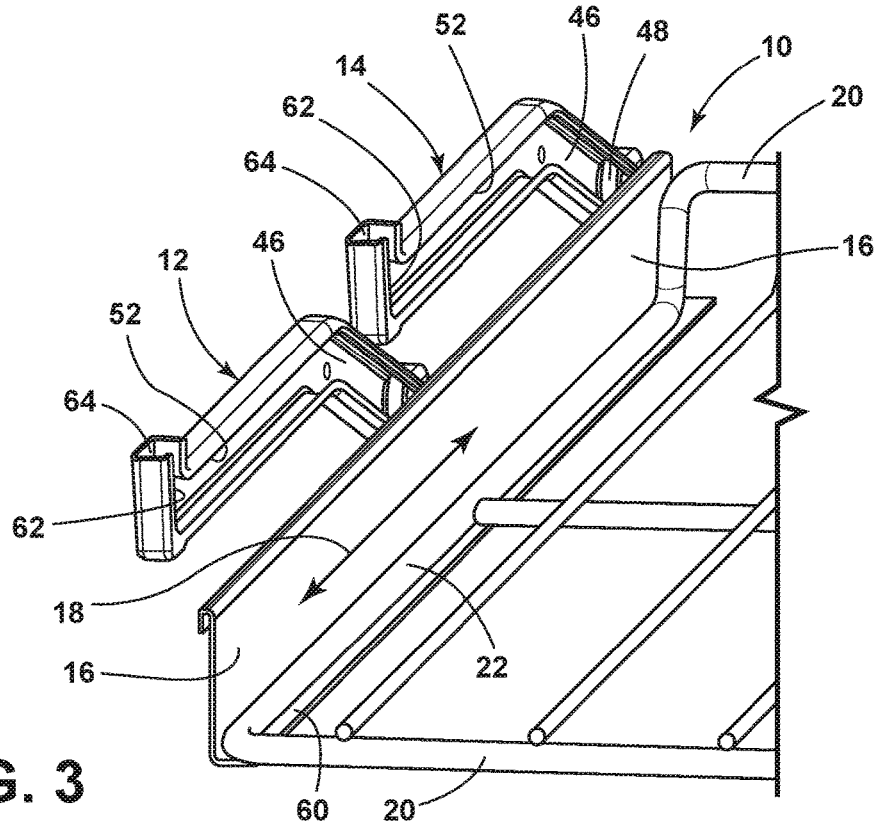
FIG. 3 is a perspective detail view of a portion of the oven rack assembly of FIG. 2.

As shown in FIGS. 2-4, first frame member 16 can be a generally L-shaped member that can be a bent or extruded member of metal or other material having sufficient heat-resistive properties, including those needed to withstand self-cleaning cycles of oven 26 or the like. First frame member 16 can define a supporting flange 60 on which rack 20 can rest. By simply resting on flange 60, rack 20 can achieve any desired sliding with respect to first frame member 16 and/or can provide for easy removal for repositioning or cleaning of rack 20. Rollers 48 can be coupled with first frame member 16 using suitable mechanical fasteners, including respective screws, bolts, rivets, and the like. Rollers 48 can be made of any material having heat resistive properties required for use inside oven 26, including various metals, as well as heat-resistive plastics elastomers (e.g. silicone or the like). Rollers 48 may also be of a material of a desired hardness to achieve a desired rolling characteristic of rollers 48 within the track portions 46,52 of mounting members 12,14 and can be fitted or otherwise assembled with bushings, bearings, and the like to promote rotation within respect to first frame member 16. In an alternative arrangement, including wherein the positioning and arrangement of mounting members 12,14 and/or the specific needs and accessibility of assembly 10 within oven 26 provides adequate access to rack 20 with the available travel in the direction of axis 18 by way of mounting members 12,14 alone, any frame members, including first frame member 16, may be eliminated. In such an arrangement, rollers 48 may be mounted directly to rack 20, by way of brackets, clips or the like, to moveably mount rack 20 to mounting members 12,14 directly. Additional modifications can be made to the resulting assembly to incorporate other features or benefits associated with mounting members 12,14, discussed further below.

Mounting members 12, 14 can further include respective stop surfaces 62 positioned at respective ends of horizontal track portions 52 opposite upwardly-angled track portions 46 so as to be contacted by rollers 48 when first frame member 16 reaches the end of the designated first range of sliding movement 56 (FIG. 6). As shown, stop surfaces 62 can be located in vertical channels 64 defined in mounting members 12,14 that can allow for first frame member 16 to be removed from mounting members 12,14 by lifting when first frame member 16 is appropriately positioned with rollers 48 adjacent stop surfaces 62.

The materials and/or construction of the features affecting the sliding movement between first frame member 16 and rack 20, as well as the rollers 48 and track portions 46,52 can be tuned such that the user can exert a force on rack 20 to urge rack 20 outwardly from cavity 30 when rack 20 is fully positioned within cavity 30 to cause rack 20 to initially move both horizontally in the direction of axis 18, as well as in the vertical direction 24 by way of movement of rollers 48 and, accordingly, first frame member 16 along the upwardly-angled track portions 46 of mounting members 12,14. Subsequently, rack 20 can move through the first range of sliding movement 56 by continued movement of first frame member 16 with respect to mounting members 12,14 by way of movement of rollers 48 through horizontal track portions 52. When rollers 48 contact stop surfaces 62, continued movement of first frame member 16 is prevented, with rack 20 sliding with respect to first frame member 16 for movement of rack 20 in the second range of sliding movement 58.

When rack 20 is to be moved back into cavity 30, the user can push rack 20 inward, causing sliding of rack 20 with respect to first frame member 16 to traverse the second range of sliding movement 58. Once rack 20 has moved into the first range of sliding movement 56, either by way of increased friction between rack 20 and first frame member 16 or by rack 20 contacting a physical stop included, for example, toward the rear of first frame member 16, the force applied to rack 20 will cause frame member 16 to move with respect to mounting members 12,14, by way of rollers 48 traversing horizontal and upwardly-angled track portions 52,46, through the first range of sliding movement 56 and through the linked portion of movement 54 to return rack 20 to its original position.

As further shown in FIG. 4, the illustrated first and second mounting members 12,14 and first frame member 16 can be positioned on one side of oven liner 28 (FIG. 5) to support side 22 of rack 20. In a similar manner, additional third and fourth mounting members 68 and 70 can be coupled on the opposite side of liner 28 to movably support a second frame member 72 coupled therewith and structured to support a second side 74 of rack 20 in a similar manner to the support of first side 22, as discussed above. As shown, third and fourth mounting members 68 and 70 can be substantial mirror-images of first and second mounting members 12 and 14 and can be similarly structured to receive rollers 48 coupled with second frame member 72 and moveable through upwardly angled 46 and horizontal 52 track portions thereof during movement of rack 20 through the ranges of motion 54,56,58, as discussed above with respect to FIG. 7.

Turning now to FIGS. 8-14, an alternative oven rack assembly 110 is shown that, in a manner similar to that which is discussed above, includes a first mounting member 112 and a second mounting member 114 and a frame 116 that is movably coupled with the first mounting member 112 and the second mounting member 114 at spaced apart positions along an axis 118 of the frame 116 and supported by the first 112 and second 114 mounting members between a first vertical position and a second vertical position, higher than the first vertical position. The first 112 and second 114 mounting members move the frame 116 between the first and second vertical positions with movement of the first frame member 116 in the direction of the axis 118. The oven rack assembly 110 further includes a rack 120 supported on a least a first side 122 thereof by the frame 116 and coupled with the frame 116 to be slideable with respect thereto along the axis 118.

In the depicted example, the first 112 and second 114 mounting members are in the form of arms respectively rotatably coupled with the frame 116 at the respective spaced-apart coupling positions 176 therealong. In this manner, the movement of the frame 116 in the direction of the axis 118 through an initial range of motion 154, shown in FIG. 14 and analogous to the linked portion of movement 54 discussed, above rotates the first and second mounting members 112,114 about respective rotation points 178 fixed with respect to the oven liner 128 (FIG. 10A) to also move the frame 116 through vertical distance 150 between first (FIGS. 8 and 13A) and second vertical positions (FIGS. 13D and 14).

Figure 9:
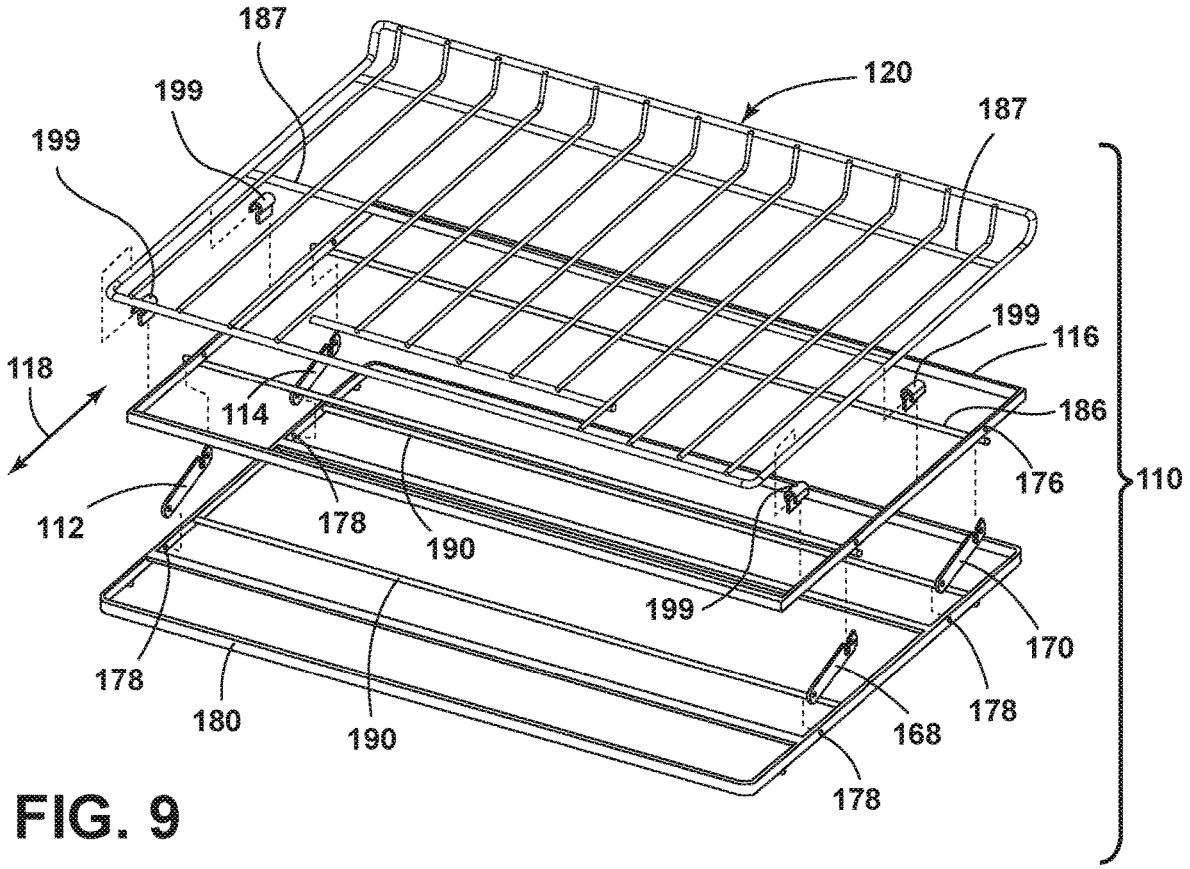
FIG. 9 is a perspective assembly view of the oven rack assembly of FIG. 8.
Figures 10A, 10B:
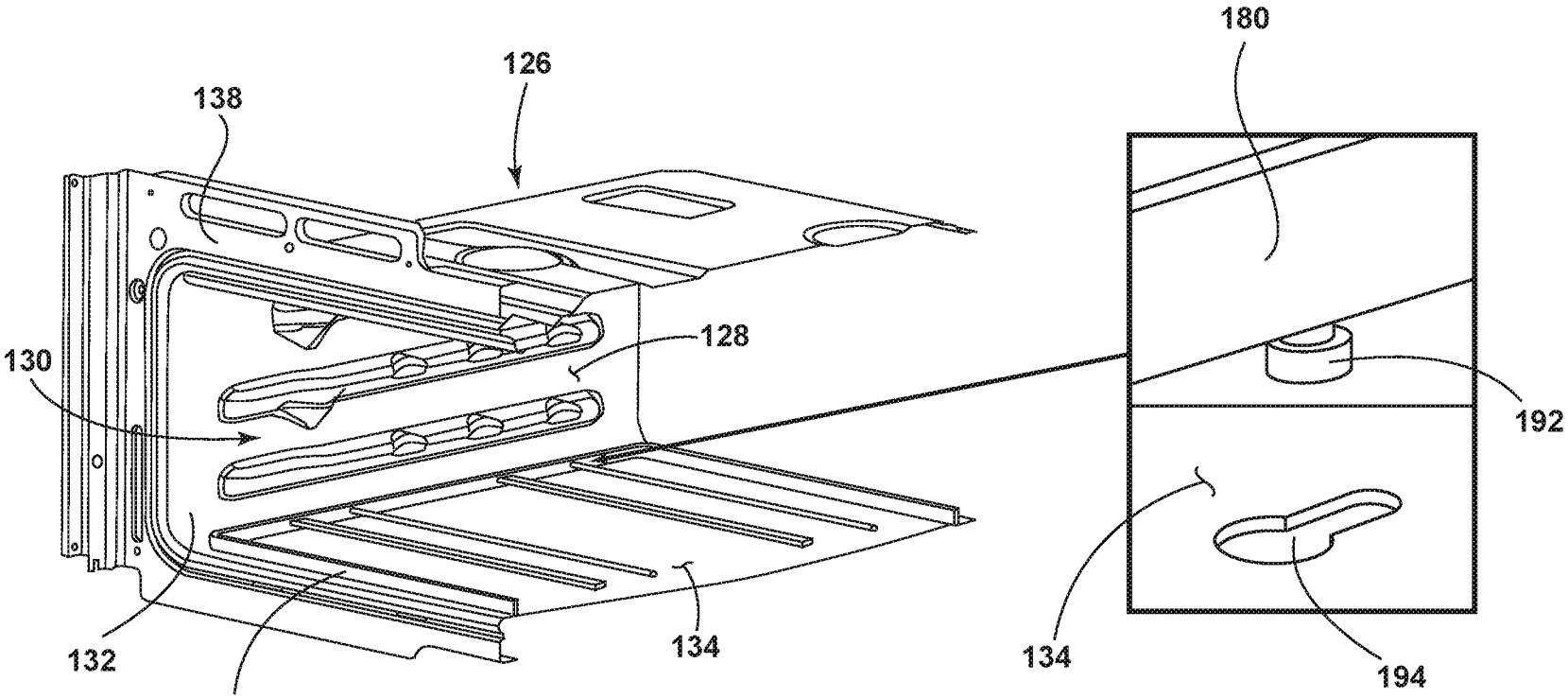
FIG. 10A is a side, cross section of a base frame of the oven rack assembly of FIG. 8 in place within the oven cavity.
FIG. 10B is a detail perspective view of an attachment arrangement of the base frame with a liner of the oven cavity.
Figure 11:
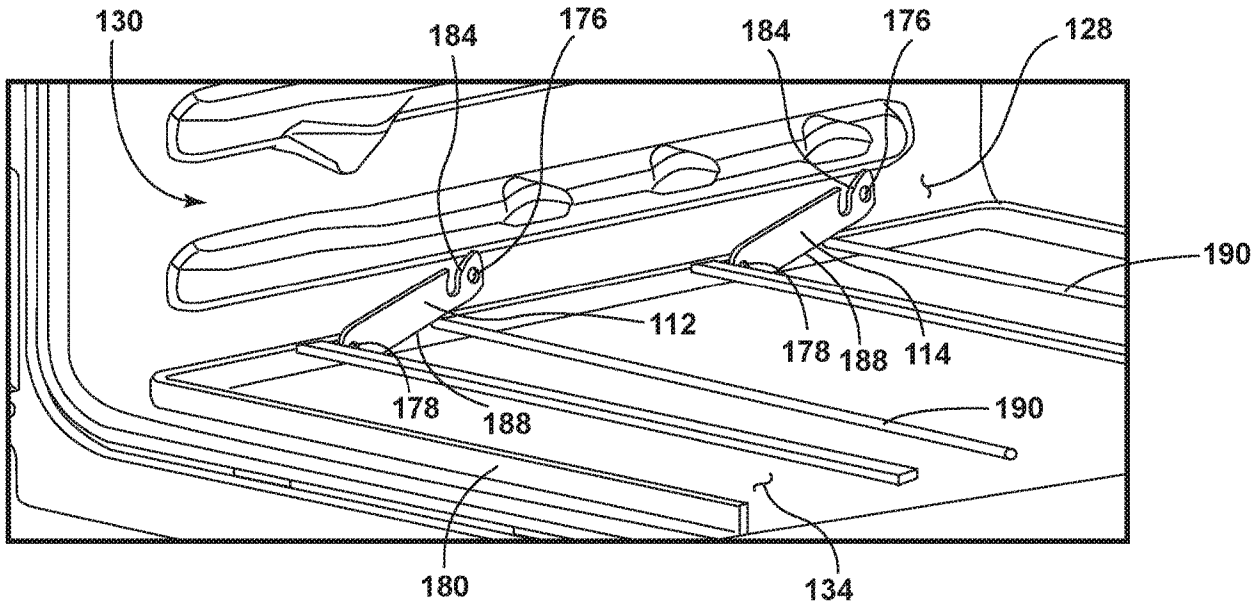
FIG. 11 is a detail perspective view of a mounting member for the oven rack assembly coupled with the base frame.
Figure 12:
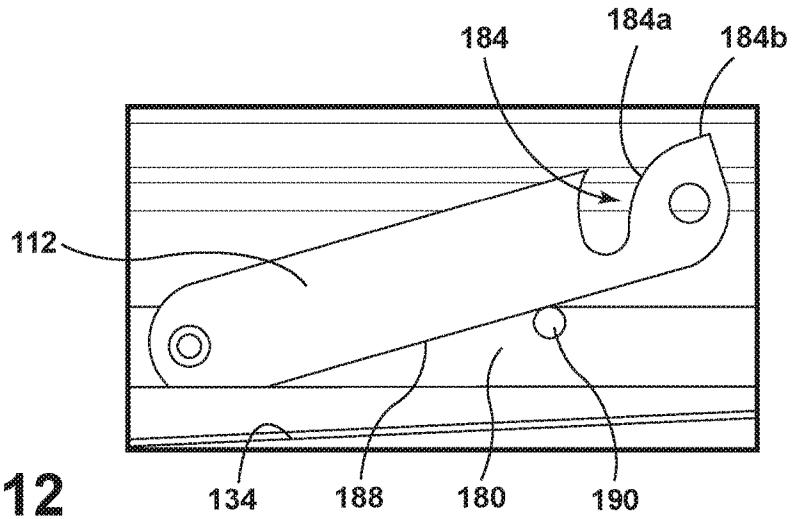
FIG. 12 is a side view of the mounting member of FIG. 11.

As particularly shown in the exploded view of FIG. 9, the present oven rack assembly 110 can further include a base frame 180. As illustrated, the first and second mounting members 112,114 are rotatably coupled with the base frame 180 at rotation points 178 by way of pins or other mechanical fasteners such as screws, rivets, or the like. In this manner, base frame 180 is fixable with the floor 134 of liner 128 (FIG. 10A) rotating with respect thereto during movement of the first frame member 116 between the first and second vertical positions. As shown in FIG. 10B, base frame 180 can include a set of feet 192, each engageable with a respective keyhole slot 194 in floor 134 of liner 128 to retain base frame 180 in its position with respect to cavity 130. Additional elements, such as set screws or the like, can further retain the position of base frame 180, including by retaining feet 192 within keyhole slots 194.

Figure 8:
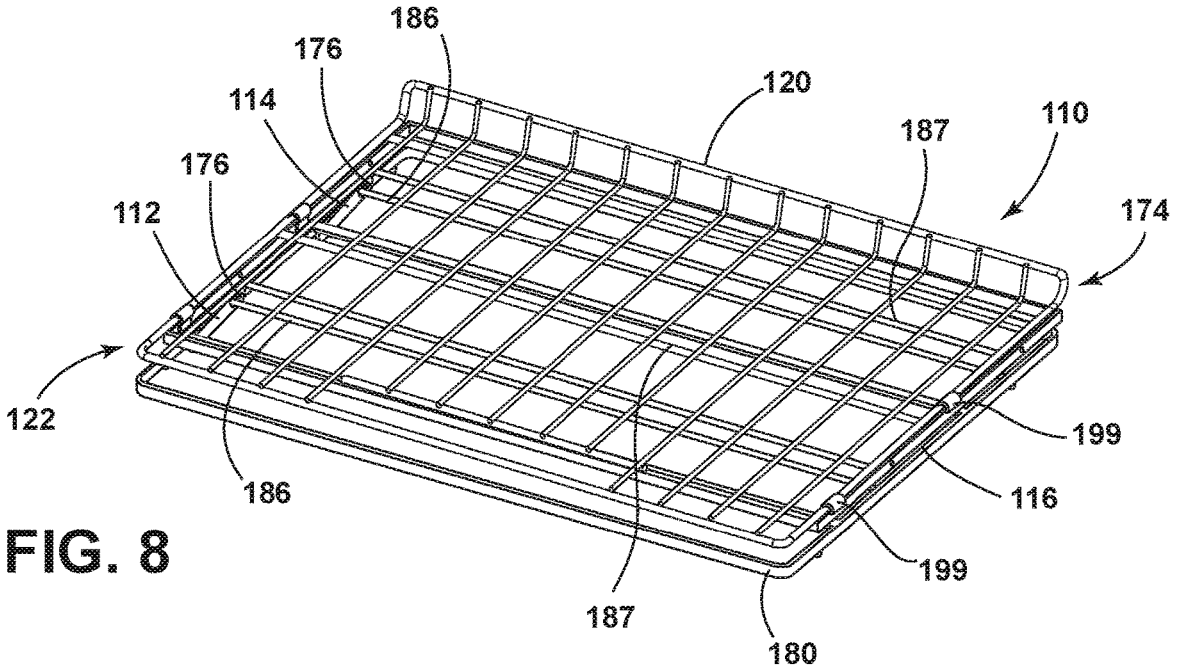
FIG. 8 is a perspective view of an alternative oven rack assembly including a frame member articulably supported on mounting members within the oven cavity.
Figure 13B:
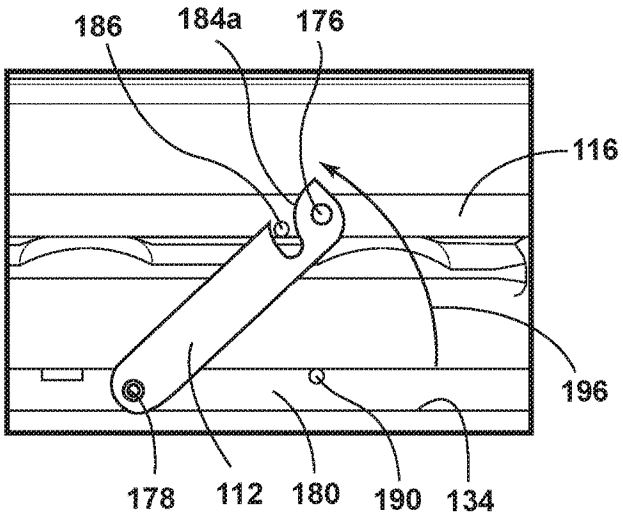
FIG. 13A-13D are side views of the mounting member of FIG. 11 supporting a frame within an oven cavity in sequential stages of movement thereof.
Figure 13A:
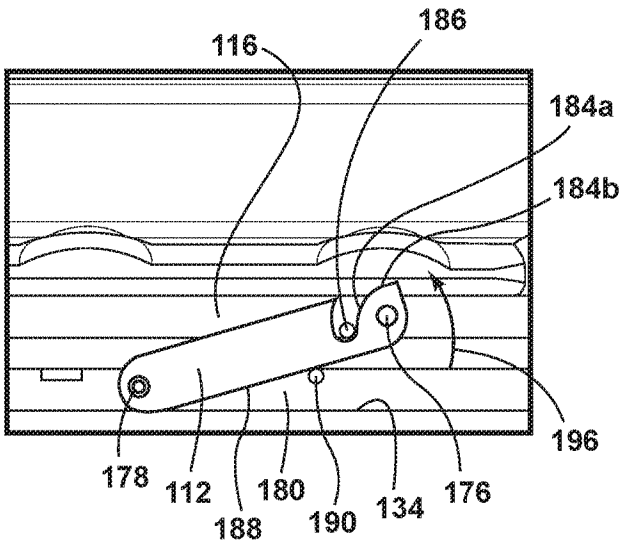
Figure 14:
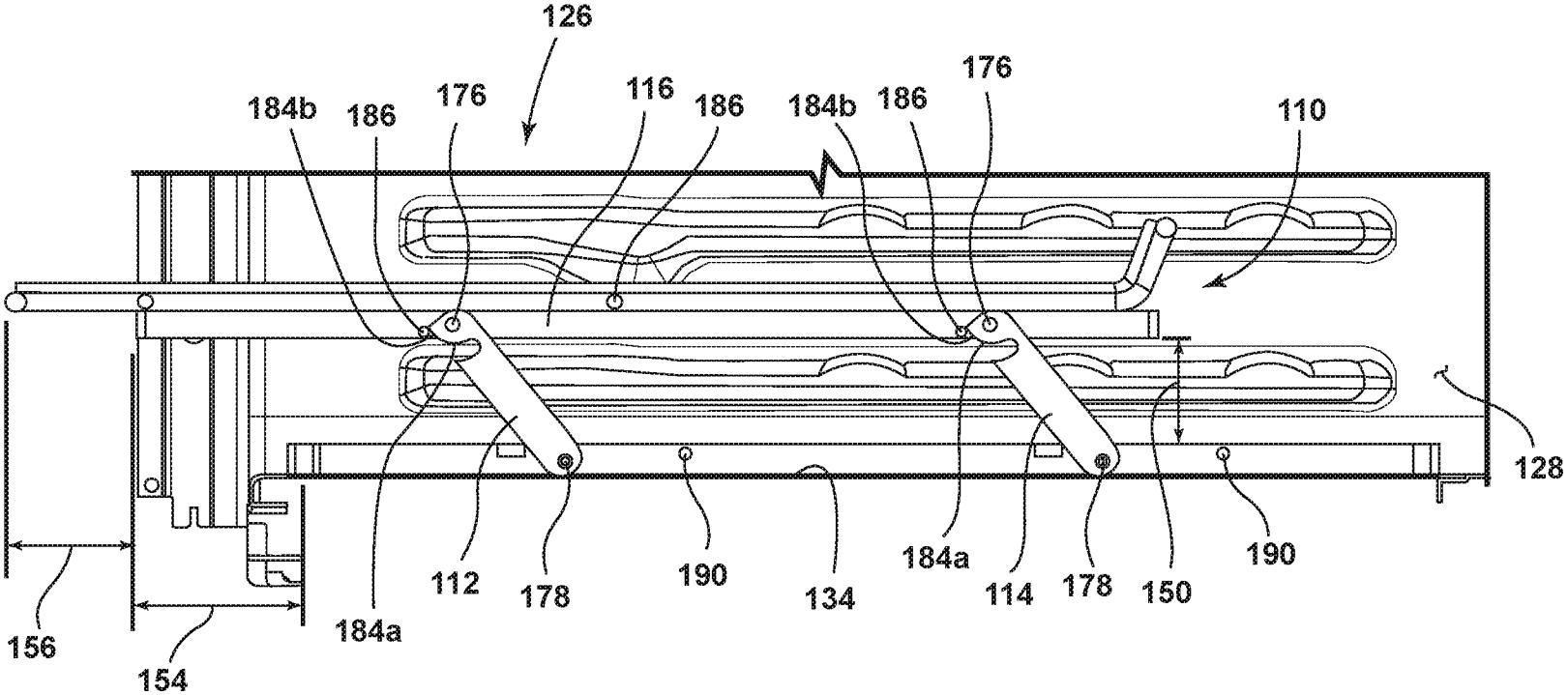
FIG. 14 is a side view of the mounting member and frame of FIGS. 13A-13D supporting a rack in a raised and extended position.

As shown in FIGS. 8 and 13A, when oven rack assembly 110 is in an initial position with rack 120 fully positioned within cavity 130, the structure of mounting members 112, 114 can position rack 120 in a lowermost position with respect to floor 134 of oven cavity 130. Rack 120 is supported in such a position by mounting members 112,114. In particular, when mounting members 112,114 are in a position corresponding with the lowermost position of rack 120, respective side surfaces 188 of mounting members 112,114 can rest, under gravity, on respective cross members 190 rigidly coupled with base frame 180 (as further illustrated in FIGS. 11 and 12).

Figure 13D:
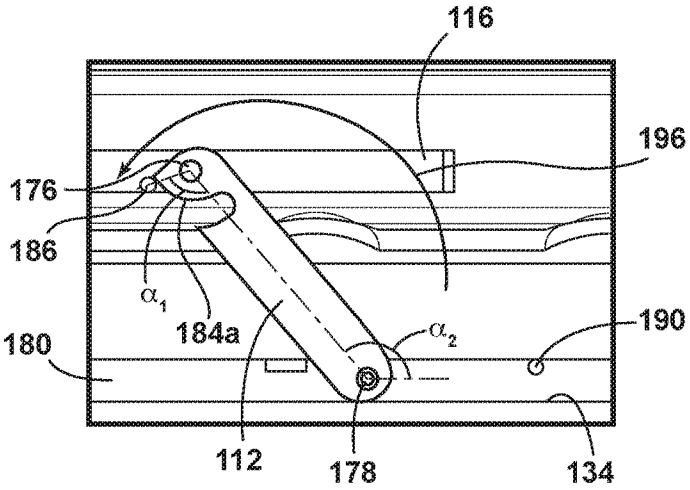
Figure 13C:
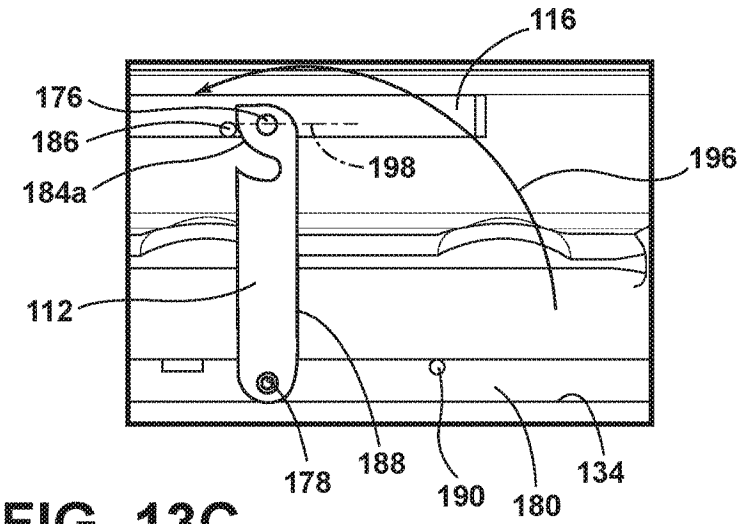

As shown in FIGS. 13A-13D, the first and second mounting members 112 and 114 can each define a respective cam surface 184 with a first portion 184*a* thereof positioned with respect to coupling point 176 to allow for rotation of the respective mounting member 112 or 114 with respect to the frame 116, such as by being positioned at a consistent radial distance form coupling point 176 throughout an angle $\alpha_1$ corresponding with an angle $\alpha_2$ of rotation of mounting members 112 and 114 with respect to rotation points 178. Cam surfaces 184 can further include respective second portions 184*b* positioned with respect to the coupling point 176 to stop further rotation of the respective mounting member 112,114 in rotational direction 196 corresponding to the initial outward movement of rack 120 from cavity 130. In this manner, coupling points 176 and cam surfaces 184 can be positioned to receive a wire member 186 rigidly coupled within or otherwise forming a portion of frame 116 (and providing structural support therefor). In this manner, the first portion 184*a* of cam surface 184 can be positioned to facilitate free movement of cam surface 184 with respect to wire members 186 during the desired range of motion for first and second mounting members 112,114, as shown in FIGS. 13A-13C. As shown in FIG. 13D, when mounting members 112,114 have rotated through the desired angle $\alpha_2$ corresponding with movement of frame 116 through vertical distance 150 and the range of range of motion 154 of rack 120, second cam portion 184*b*, which can extend away from coupling point 176 compared the first portion 184*a*, can contact wire member 186, thereby preventing further movement of mounting members 112,114 beyond angle $\alpha_2$ such that wire member 186 can act as a stop portion of the frame 116. In an alternative arrangement, a pin or other structure can similarly function as a stop member in a similar manner.

As shown in FIGS. 13C and 13D, the initial movement of the frame 116 in the direction of axis 118 with movement of rack 120 in through the linked range of motion 154 rotates the first and second mounting members 112,114 through a generally vertical position such that coupling points 176 pass an apex 198. In such an instance, the frame 116 (and, correspondingly, rack 120) are above the desired final vertical position for rack 120 such that complete movement of frame 116 and rack 120 through the linked range of motion 154 brings mounting members 112,114 past the vertical position such that wire member 186 rests against the second portion 184*b* of the cam surface 184 under gravity to maintain the frame 116 and rack 120 in the desired raised position shown in FIG. 13D.

As shown in FIG. 14, the initial movement of rack 120 along with frame 116 through the linked range of motion 154 to elevate rack 120 by rotation of mounting members 112,114 may only somewhat extend rack 120 from cavity 130. To achieve further movement of rack 120 from cavity 130, rack 120 can be slidably mounted with frame 116. As also shown in FIG. 9, rack 120 can be coupled with frame 116 by way of a plurality of clips 199 with generally cylindrical portions disposed in the direction of axis 118 such that rack 120 can slide with respect to clips 199 in the direction of axis 118 while being otherwise retained with frame 116. In this respect, the materials selected for clips 199, as well as the relative sizing between clips 199 and the portion of frame 116 received therein can be tuned to provide a level of friction therebetween to control the desired sliding movement between rack 120 and frame 116. For example, such friction can be such that, as discussed above, initial movement of rack 120 under the force of a user forces movement of frame 116 under rotation of mounting members 112,114 such that linked movement of rack 120 in the direction of axis 118 along with movement through the vertical range of motion 154 occurs before sliding of rack 120 with respect to frame 116. Sliding movement of rack 120 with respect to frame 116 can be stopped by a respective cross member 187 of rack 120 (of which clips 199 are positioned between in the direction of axis 118) coming into contact with one of the clips 199. As can be appreciated, because frame 116 is fixed with respect to mounting members 112,114 about coupling points 178, the total range of sliding motion 156 for rack 120 is due to such sliding. In a similar manner, to that which is discussed above, the positioning and arrangement of mounting members 112,114 and/or the specific needs and accessibility of assembly 110 within oven 126 may provide adequate access to rack 120 with the available travel in the direction of axis 118 by way of the rotation of mounting members 112,114 alone. In such an arrangement, frame 116 may be eliminated, and rack 120 may be coupled with mounting members 112,114 directly. Further similar to that which is discussed above, additional modifications can be made to the resulting assembly, including with respect to rack 120, to incorporate other features or benefits associated with mounting members 112,114, discussed elsewhere herein.

In a similar manner to that which is discussed above with respect to FIGS. 2-7, movement of rack 120 back into cavity 130 may occur in substantially a reverse process from that which is shown in FIGS. 13A-13D and 14. In particular, a force applied to rack 120 may cause rack 120 to slide toward cavity 130 in the direction of axis 118 through clips 199 with frame 116 remaining stationary. Upon rack 120 sliding through the designated range of sliding motion 156, another respective cross member 187 comes into contact with at least one of the clips 199, thereby applying the force against rack 120 in the direction of axis 118 to frame 116. This force causes movement of frame 116 and rack 120 through the linked range of motion 154 by rotation of mounting members 112,114 toward cross members 190. The movement of oven rack assembly 110 is stopped when side surfaces 188 of mounting members 112,114 contact cross members 190.

As further shown in FIGS. 8 and 9, the above-described first and second mounting members 112,114 are coupled with the frame 116 on a first side 122 thereof, frame 116 being a generally rectangular rack-like element that extends generally along an entirety of rack 120 in both length and width. In this manner, oven rack assembly 110 may further include third 168 and fourth 170 mounting members respectively rotatably coupled with the frame 116 on a second side thereof 174 about respective coupling points 176. In such an arrangement, the movement of the frame 116 in the direction of the axis 118 rotates the third and fourth mounting members 168,170 to further support movement of the frame 116 through vertical distance 150. Third and fourth mounting members 168,170 can be similarly structured to first and second mounting members 112,114 and can interact with base frame 180 and frame 116 in a similar manner.

Referring back to FIG. 1, the structure of oven rack assembly 10 can be such that the vertical distance 50 through which rack 20 is raised during the linked portion of movement 54 can be between about 15 mm and 50 mm and in one embodiment between about 30 mm and 40 mm. As further shown, the vertical distance 50 can be sufficient to raise rack 20 from an initial position wherein rack 20 is spaced from floor 34 by about 15 mm to a height sufficient to clear door 36 when in the open position, which may extend over opening 32 by a distance D (FIG. 1) of about 30 mm, with additional clearance to allow a user to grasp and/or otherwise manipulate rack 20, as desired, without contacting the inner face 42 of door 36, which may be hot. The horizontal distance 54 (FIG. 7) traversed during such linked movement may be on the order of the vertical distance 50 and may be between about 20 mm and 70 mm, depending on the geometry of mounting members 12,14 and the desired characteristics of movement of first frame member 16 with respect thereto (including the initial force desired for movement, etc.). With continued reference to FIG. 7, the first range of sliding motion 56 of first frame member 16 (and rack 20 therewith) with respect to mounting members 12,14 and the second range of sliding motion 58 (of rack 20 with respect to first frame member 16) can combine to be about 200 mm to 300 mm and, in a particular embodiment, can be about 250 mm.

The values for the comparable ranges of motion of oven rack assembly 110, as shown in FIG. 14 can be similar to those of oven rack assembly 10, with the sliding range of motion 156 of rack 120 with respect to frame 116 being on the order of the combined first 56 and second 58 ranges of sliding motion described above. To achieve such movement, mounting members 112,114,168,170 can be between about 40 mm and 60 mm in length and can rotate from an initial position at an angle of about 16° with respect to floor 134 through angle $\alpha_2$ of about 130° with the above-described apex position of coupling point 176 corresponding with mounting members 112,114,168,170 being at about 90° with respect to floor 134. It is to be understood that any of the above-described dimensions may vary depending on the structure and dimensions of oven 26 or 126 and the desired motion characteristics of oven rack assembly 10 or 110 that may vary therewith.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An oven rack assembly, comprising:

a first track and a second track, respectively, each of the first and second tracks having respective upwardly-angled portions and upper horizontal portions, the first track including a stop portion having a vertical surface positioned at an end of the upper horizontal portion, a vertical channel being partially defined by the vertical surface and open to the upper horizontal portion;

a first frame member being slidably coupled with the first and second tracks such that a movement of the first frame member through a first range of motion in the direction of the axis through the upwardly-angled portions of the first and second tracks moves the first frame member between a first vertical position and a second vertical position higher than the first vertical position, and such that movement of the frame member through a second range of motion in the direction of the axis through the upper horizontal portions moves the first frame member along the axis in the second vertical position, wherein the second range of motion is greater than the first range of motion, the first frame member further being coupled with the first track by a roller received therein, the roller being removable from the first track by movement thereof through the vertical channel such that the first frame member is decoupleable from the first track; and a first rack supported on at least a first side thereof by the first frame member and coupled with the first frame member to be slideable with respect thereto along the axis.

2. The oven rack assembly of claim 1, wherein the first rack is slideable in the second vertical position with respect to the first and second tracks through a total distance comprising a first distance portion achieved by sliding of the first frame member with respect to the first and second tracks and a second distance portion achieved by sliding of the rack with respect to the first frame member.

3. The oven rack assembly of claim 2, wherein the first distance portion is the second range of motion.

4. The oven rack assembly of claim 1, further comprising:

third and fourth tracks; and a second frame member movably coupled with the third track and the fourth track at spaced apart positions along an axis of the second frame member and supported by the third and fourth tracks between the first vertical position and the second vertical position, wherein:

the first rack is supported on a second side thereof opposite the first side by the second frame member and coupled with the second frame member to be slideable with respect thereto along the axis.

5. The oven rack of claim 1, wherein the second track includes a second stop portion having a vertical surface positioned at an end of the upper horizontal portion.

6. The oven rack assembly of claim 1, wherein the horizontal portions are longer in a distance along the axis than the upwardly-angled portions in a distance along the axis.

7. The oven rack assembly of claim 1, wherein the first rack is supported on the first and second tracks by the frame member during movement thereof along the axis in a sliding manner with respect to the first and second tracks and in a vertical direction between the first vertical position and the second vertical position.

8. An oven, comprising: an interior liner defining a cavity having an opening and a floor surface extending inward from the opening;

a door moveable between an open position and a closed position over the opening of the cavity, a portion of the door extending over a portion of the opening when in the open position;

and an oven rack assembly including:

first and second tracks, each having respective upwardly-angled portions and horizontal portions extending in the outward direction away from the respective upwardly-angled portions;

a first rack mounted within the cavity and moveable in an outward direction with respect to the cavity and in a vertical direction between a first vertical position, wherein a portion of the rack is disposed below a portion of the door, when in the open position, and a second vertical position, wherein the entire rack is disposed above the door, when in the open position; and a first frame member supporting the first rack, being slideably coupled with the first and second tracks at spaced apart positions along an axis of the first frame member, and supported by the first and second tracks to move the first frame member between the first vertical position and the second vertical position, wherein:

the first rack is supported on at least a first side thereof by the first frame member and is coupled with the first frame member to be slideable with respect thereto in an outward direction with respect to the cavity such that movement of the first frame member in the outward direction through the upwardly-angled portions of the first and second tracks moves the first frame member between the first and second vertical positions, the first frame member being further slideable along the axis with respect to the first and second trackswhen in the second vertical position; and the horizontal portions are longer in a distance along the axis than the upwardly-angled portions in a distance along the axis.

9. The oven of claim 8, wherein a movement of the first rack in the outward direction through a first portion of a range of outward motion of the first rack is linked with a movement of the first rack in the vertical direction between the first vertical position and the second vertical position.

10. The oven of claim 8, wherein the first track includes a stop portion having a vertical surface positioned at an end of the upper horizontal portion.

11. The oven of claim 10, wherein the stop portion further includes a vertical channel partially defined by the vertical surface, the vertical channel being open to the upper horizontal portion.

12. The oven of claim 8, wherein the first rack is supported on the first and second tracks by the frame member during movement thereof along the axis in a sliding manner with respect to the first and second tracks and in a vertical direction between the first vertical position and the second vertical position.

13. An oven rack assembly, comprising:

first and second mounting members;

a frame member slidably coupled with the first and second mounting members and limited in motion to movement with the first and second mounting members;

a first rack supported on the first and second mounting members by the frame member and moveable along an axis of the rack in a sliding manner with respect to the first and second mounting members and in a vertical direction between a first vertical position and a second vertical position higher than the first vertical position, the first and second mounting members moving the first rack between the first and second vertical positions with movement of the first rack along the axis through a first range of motion, the first and second mounting members further moving the first rack in a horizontal direction through a second range of motion that is greater than the first range of motion with continued movement of the first rack along the axis.

14. The oven rack assembly of claim 13, wherein the first mounting member is a first track that includes a stop portion having a vertical surface positioned at an end of the upper horizontal portion.

15. The oven rack assembly of claim 14, wherein the stop portion further includes a vertical channel partially defined by the vertical surface, the vertical channel being open to the upper horizontal portion.

* * * * *